US006308596B1

(12) United States Patent
Williams

(10) Patent No.: US 6,308,596 B1
(45) **Date of Patent: *Oct. 30, 2001**

(54) HAND WRENCH TORQUE ENHANCING DEVICE

(76) Inventor: Elden Williams, 3580 Dwayne Ct., Redding, CA (US) 96001

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/116,076

(22) Filed: Jul. 15, 1998

(51) Int. Cl.[7] ..... B25B 23/16
(52) U.S. Cl. ..... 81/177.2; 81/177.1
(58) Field of Search ..... 81/177.1, 177.2; 294/92

(56) References Cited

U.S. PATENT DOCUMENTS

| | | | | |
|---|---|---|---|---|
| 107,425 | | 9/1870 | Tregellas . | |
| D. 298,007 | | 10/1988 | Williams et al. . | |
| 1,463,077 | | 7/1923 | Gandell . | |
| 1,472,517 | | 10/1923 | Fry . | |
| 1,511,738 | | 10/1924 | Lownsbery . | |
| 1,689,639 | * | 10/1928 | Neff | 81/177.2 |
| 2,490,739 | | 12/1949 | Nesbitt . | |
| 2,691,316 | * | 10/1954 | Brame | 81/177.2 |
| 2,725,773 | * | 12/1955 | Anacker | 81/177.2 |
| 3,587,307 | | 6/1971 | Newberg . | |
| 3,745,362 | | 7/1973 | Sharp . | |
| 4,104,935 | | 8/1978 | Stoops . | |
| 4,644,600 | | 2/1987 | Fugate . | |
| 4,960,014 | | 10/1990 | Kelley . | |
| 5,279,189 | | 1/1994 | Mariso . | |
| 5,419,221 | | 5/1995 | Cole . | |

* cited by examiner

*Primary Examiner*—James G. Smith
(74) *Attorney, Agent, or Firm*—Coudert Brothers

(57) ABSTRACT

An extension device for wrenches includes an extension member with a wedge brace comprised of two counterpoised wedge couplers. The wedge couplers comprise wedge fingers defining offset opposed wedge slots such that the wedge couplers engage opposite sides of a tool handle in a counterpoised manner to wedge-lock a tool handle into place.

15 Claims, 6 Drawing Sheets

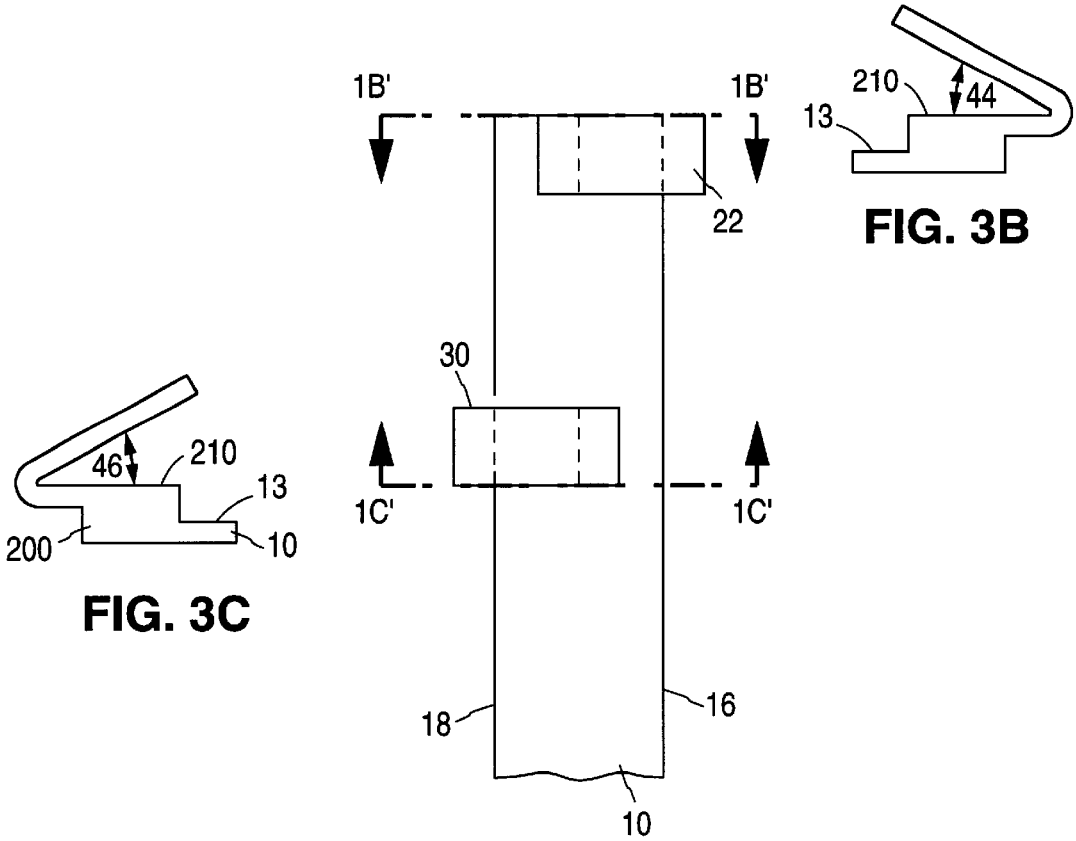
FIG. 3B
FIG. 3C
FIG. 3A
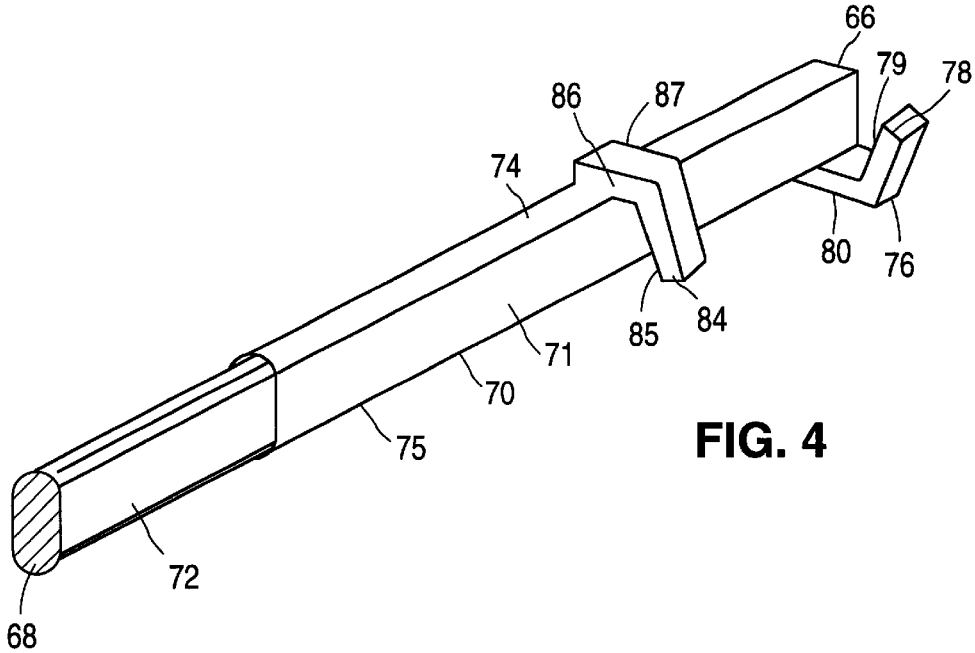
FIG. 4

HAND WRENCH TORQUE ENHANCING DEVICE

FIELD OF THE INVENTION

This invention relates to extension handles for tools in general, and more particularly to an extension handle for wrenches.

BACKGROUND OF THE INVENTION

There are many applications where it is desirable to extend the effective length of a tool. Increasing the lever arm of a tool increases the mechanical advantage of the tool. As one example, a crowbar with a long lever arm is useful for prying apart strongly coupled pieces of wood or metal. As another example, it is desirable to have a long lever arm on a vertical car-jack in order to increase the mechanical advantage such that a heavy car can be jacked up with normal arm strength.

Mechanics often desire to increase the effective length of a wrench. This increases the mechanical lever arm of the wrench, thereby permitting greater torque to be applied to a nut. This is particularly desirable if the nut which is to be loosed is frozen or otherwise requires a large torque in order for it to be removed. For example, head bolts in diesel engines are typically tightened to 500 ft-lbs of torque. Consequently, a wrench with a long effective lever arm is desirable to break such nuts loose. There are also other applications where it is difficult with common wrenches to apply sufficient torque to a nut. For example, many wrenches used for common nut sizes, such as ⅜" wrenches, are commonly available in lengths substantially less than one foot in length (e.g., six to ten inches). The short lever arm of such wrenches makes it difficult for professional mechanics to apply sufficient torque to crack tight nuts. Furthermore, a short lever arm may make it impossible for many home mechanics with limited strength (e.g., the elderly and the disabled) to apply sufficient torque to loosen frozen nuts.

There are also other applications where it is desirable to increase the effective handle length of a wrench. In particular, increasing the effective handle length of a wrench is often desirable in applications when a mechanic must tighten and/or loosen nuts in a compact, restricted space, such as in an automobile engine. Mechanics often have "short handled" and "long handled" versions of common wrenches in order to increase their cap to grasp the tool in a "clear area" while applying torque to a nut in a recessed or constrained area. However, for economical and practical reasons conventional wrenches typically come in only a limited range of lengths (e.g., conventional ⅜" wrenches typically have handle lengths substantially less than one foot in length) such that conventional wrenches are often not of a convenient length to be used to tighten and/or loosen nuts in a restricted space.

One technique that mechanics commonly use to surmount the limitations of the limited handle length of common wrenches is to insert the opposite end of the wrench into a length of cylindrical pipe, thereby increasing the effective handle length of the wrench. Such a pipe-extension permits a mechanic to greatly increase the lever arm of common wrenches, and thus apply a substantial torque to a nut. However, using a pipe extension has many drawbacks. For example, inserting one end of a ⅜" wrench into a two-foot long piece of pipe with an inner diameter slightly larger than the cross sectional width of the end of the wrench more than doubles the lever arm of a conventional ⅜" wrench having a handle that is less than one foot in length. One problem is that the wrench may slip in the pipe during its use so as to cause the nut to be stripped. Another problem is that a pipe extension can be a safety hazard. At high torque levels, a wrench that slips in a pipe extension may cause the wrench to fly off of the nut. Automobile mechanics often bruise their knuckles when such pipe-extensions slip during use. There are also some high-torque applications where a wrench may be thrown with substantial momentum if the pipe extension slips during use. For example, mechanics sometimes use a pipe extension to increase the lever arm of pipe wrenches. However, a pipe extension may slip, particularly if a mechanic attempts to tighten overhead pipes. Consequently, the pipe wrench may be thrown and/or fall onto the mechanic.

The inventor of the present invention believes that mechanics continue to use pipe-extensions as a means to increase the length of their wrenches because previously known wrench extension handles do not adequately solve the problems of providing an economical extension handle that can be used with a wide variety of wrench sizes and which provides a secure grip on a wrench at high torque. Previously known wrench extension handles, such as that described in U.S. Pat. No. 1,511,738, commonly use two oppositely positioned stirrups to receive the wrench handle near one end of the extension handle. The stirrups are typically substantially U-shaped holders spaced apart a short distance on one end of an extension bar. The wrench is held by the slots formed by the two U-shaped holders, thereby increasing the effective lever arm of the wrench. However, unless the wrench handle has a thickness substantially the same as that of the slot width of the U-shaped holders, there may be excessive "play" between the wrench handle and the U-shaped holders. Even a very small amount of play between a U-shaped holder and a wrench handle may be unacceptable at high torque levels. These problems tend to limit conventional wrench extension handles to use with a narrow range of wrench sizes (e.g., wrenches with a handle thickness and width comparable to the U-shaped holders) and to comparatively low torque levels.

There are other limitations to the wide-scale use of previously known wrench extension handles. Previously known extension handles are commonly designed such that only a small portion of the wrench (e.g., the open or box end) may extend out from the extension handle. This facilitates the mechanical coupling of the wrench to the extension handle and helps to reduce the play of the wrench. However, it is highly undesirable because mechanics typically require a wide range of effective handle lengths. As previously described, a mechanic often needs to extend a wrench to provide greater accessability to nuts which are located in a constrained area. The effective wrench length may be defined as the total length of the wrench as placed in the extension handle. In some applications, there may only be a limited "window" of effective wrench lengths for which the mechanic may firmly grasp the extension handle while still being able to turn the extension handle. Consequently, previously known extension handles may not be suitable for use in constrained spaces because the effective wrench length is not selectable.

Another limitation of previously known wrench extension handles is that they do not accommodate a range of wrench shapes. A mechanic often uses wrenches with angled box-ends in addition to flat open-ended wrenches. Box-end wrenches typically have a box end angled at thirty degrees, although box-end wrenches with a box end angled at forty-five degrees are also commonly used. The angled box-ends make it difficult to design U-shaped holders which provide a strong mechanical coupling to the wrench. One attempted solution, as described in U.S. Pat. No. 4,960,014, is to elevate the U-shaped holders relative to the rest of the extension handle such that the U-shaped holders will couple to the flat handle portions of the curved wrench. However, elevating the U-shaped holders raises the body of the wrench above the extension handle such that at most one point on the back end of the curved wrench contacts the handle. This makes a precise matching of the size of the wrench (e.g., wrench thickness, width, and length) to the U-shaped holders more difficult to achieve to avoid play, particularly if the extension handle is cocked at a slight angle with respect to the nut.

The ideal extension handle for wrenches would provide a firm coupling to a wrench even at extremely high torque levels. The extension handle would also maintain a firm coupling even if the extension handle was slightly tilted with respect to the plane of the nut. Additionally, the ideal extension handle would be compatible with a wide range of wrench handle thicknesses, widths, lengths, and curvature such that a mechanic could use a small number of extension handles to extend a large number of different wrench sizes and types. Moreover, the ideal extension handle would permit a mechanic the capability to conveniently adjust the effective length of his wrench to facilitate using the extended wrench in constrained spaces, thus eliminating the need to have a large variety of extension handle lengths. Unfortunately, no previously known extension handle for wrenches provides a practical means to achieve these objectives.

What is desired is an extension handle suitable for a wide range of wrench types and dimensions that permits a wrench to be adjustably extended from the extension handle and which firmly holds the wrench in place during use even at high torque levels.

SUMMARY OF THE INVENTION

The present invention generally comprises an extension device having an extension member with a wedge brace to engage a handle. The wedge brace comprises two offset opposed wedge fingers that are spaced apart along the length of the extension member. The wedge fingers form wedge-effect slots with portions of the extension member. The wedge-effect slots engage opposite sides of a handle in a counterpoised manner such that the handle is wedge-locked into place.

In one embodiment, additional riser segments are included along the extension member adjacent to the wedge fingers. The risers raise the wedge-effect slots above the surface of the extension member, enabling handles with substantial curvature along their length to be engaged by the wedge brace.

In another embodiment, the wedge fingers have at least two finger segments. A first finger segment has a substantially planar surface which forms a substantially V-shaped wedge slot with the surface of the extension member. A second finger segment couples the first finger joint to the extension member. The second finger joint is dimensioned to increase the displacement between the first finger segment and the surface of the extension member in wedge-effect regions.

In yet another embodiment, the extension device includes an offset mating member to accommodate a tool with an offset handle The offset mating member facilitates extending box-end wrenches with the extended wrench and extension device forming a substantially co-planar arrangement.

BRIEF DESCRIPTION OF THE DRAWINGS

FIG. 3A is a top view of the extension member of FIG. 1A with additional riser sections underneath the wedge fingers.

FIG. 3B is a partial cross-sectional view of a tool wedged into a first elevated wedge coupler along the line 1B—1B of FIG. 3A.

FIG. 3C is a partial cross-sectional view of a tool wedged into a second elevated wedge coupler along the line 1C—1C of FIG. 3A.

FIG. 4 is a perspective view of an extension device of the present invention suitable for pipe wrenches.

DETAILED DESCRIPTION OF THE INVENTION

The present invention generally comprises an extension handle in which a counterpoised wedge effect is used to brace a tool handle into a secure position on the extension handle during normal use. In the context of this application, "counterpoised" refers to an equilibrium condition in which opposing forces are in balance. A "counterpoised wedge effect" is a condition where the opposing forces from two offset opposing wedge surfaces engage and hold opposite sides of a tool handle.

Figures 1A, 1B, 1C:
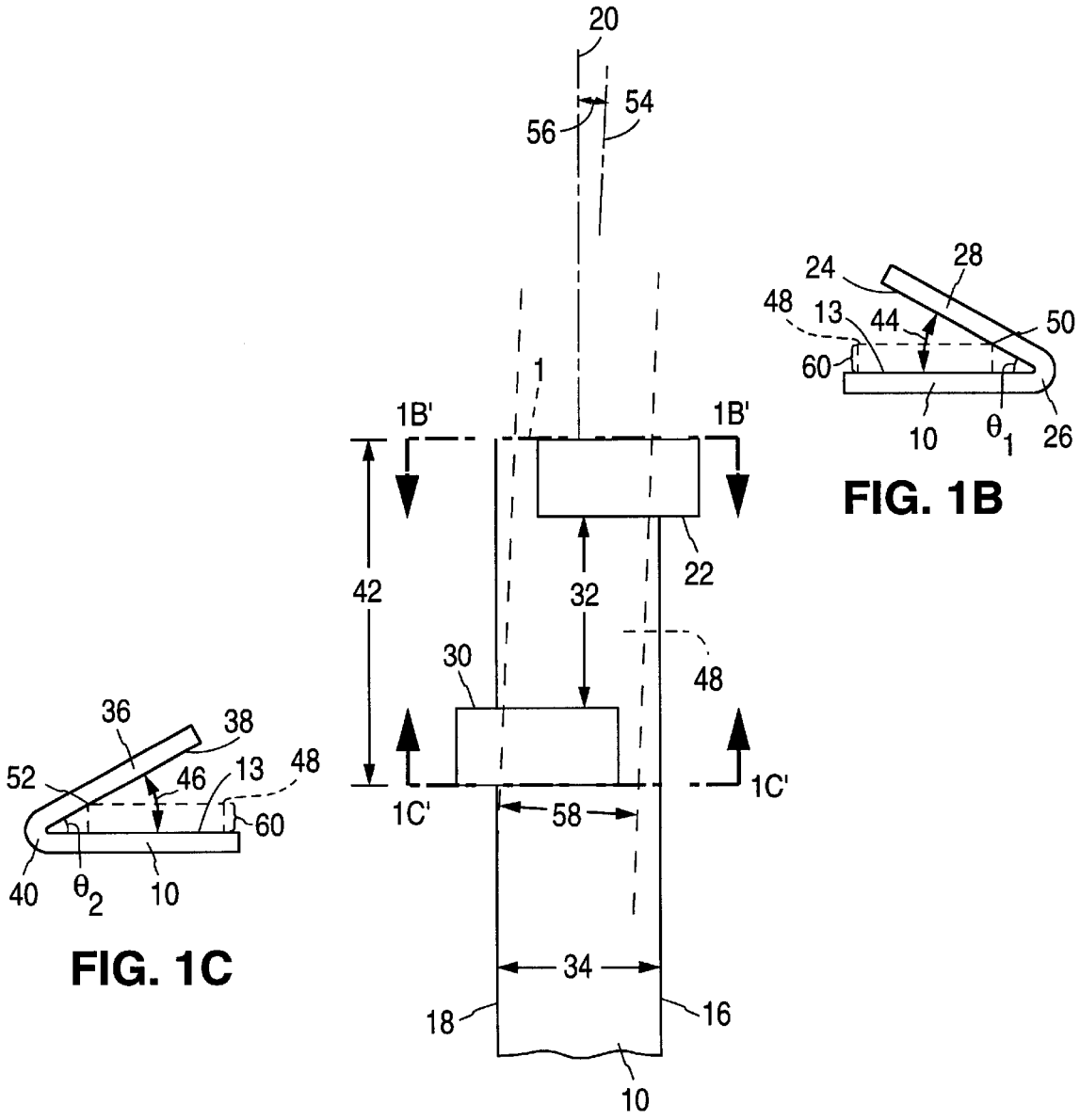
FIG. 1A is a top view of an extension member with a wedge brace engaging a tool handle in a preferred manner such that the axis of the tool handle is substantially coaxial with the axis of the extension member.
FIG. 1B is a partial cross-sectional view of a tool wedged into a first wedge coupler along the line 1B—1B of FIG. 1A.
FIG. 1C is a partial cross-sectional view of a tool wedged into a second wedge coupler along the line 1C—1C of FIG. 1A.

A top view of an extension device of the present invention is shown in FIG. 1A. An extension member 10 comprises a substantially planar strip having a first end 1, a first longitudinal side 16, and a second longitudinal side 18. Extension member 10 also has a longitudinal axis 20.

A first wedge finger 22 is disposed proximate to the first end along side 16. As shown in FIG. 1B, first wedge finger 22 comprises a first wedge finger segment 28. The first wedge finger segment 28 has a first wedge surface 24 which forms a first wedge slot 44 with the surface 13 of the extension member 10. The first wedge surface 24 is a substantially planar surface which is tilted with respect to the plane of the surface 13 of extension member 10 by predetermined angle $\theta_1$. The first wedge surface 24 disposed on first wedge finger segment 28 is coupled to the extension member 10 by a second wedge finger segment 26. The first wedge finger segment 28 and the second wedge finger segment 26 comprise the first wedge finger 22. The second wedge finger segment 26 may comprise a short curved segment to couple the first wedge finger to the extension member.

A second wedge finger 30 is spaced apart from first wedge finger 22 along the axis of the extension member 10 by a distance 32. As shown in FIG. 1C, a second wedge finger 30 comprises a first opposed wedge finger segment 36. First opposed wedge finger segment 36 has a second wedge surface 38 which forms a second a wedge slot 46. The second wedge surface 38 is a substantially planar surface which is tilted with respect to the surface 13 of the extension member 10 by a predetermined angle $\theta_2$. The first opposed wedge finger segment 36 is coupled to the extension member 10 by a second opposed wedge finger segment 40. The first opposed wedge finger segment 36 and the second opposed wedge finger segment 40 comprise the second wedge finger 30. The second opposed wedge finger segment 40 may comprise a short curved segment to couple the first opposed wedge finger segment 36 to the extension member.

The first wedge finger 22 and second wedge finger 30 comprise a wedge brace 42 coupled to extension member 10. The first wedge finger 22 forms a first wedge slot 44 which is opposed to a second wedge slot 46 formed by second wedge finger 30. The wedge slots 44 and 46 comprise wedge couplers which, as described below in more detail, engage a tool handle.

The wedge slots 44 and 46 are preferably generally V-shaped with an arc angle of less than forty-five degrees. An arc angle of thirty degrees appears to work the best in practice. However, the wedge slots could have a somewhat curved shape while still retaining their ability to function as wedge slots. As shown in FIG. 1B and 1C, first wedge surface 24 and second wedge surface 38 are opposed in the sense that they form approximately the same angle with respect to opposite sides of the extension member 10. Also, as describe below in more detail, the surfaces are opposed in the sense that the two wedge surfaces apply forces to opposite sides of a tool handle to wedge-lock a handle into place.

A handle 48 may be inserted in the wedge brace 42 of extension member 10. The handle 48 may be of variable width and thickness. However, the width 58 of the handle 48 should be less than the width 34 of extension member 10. The tool handle 48 has a handle axis 54. The handle is rotated by an angle 56 with respect to the longitudinal axis 20 of extension member 10 until the tool is counterpoised braced between a first wedge-effect region 50 and a second wedge-effect region 52. The wedge effect region is the region where the tool handle is tightly wedge-coupled to the extension member. Those of ordinary skill in the art of mechanical engineering could calculate the regions where the wedge forces are strongest. However, generally the wedge effect regions correspond to those areas where the handle contacts both the surface 13 of the extension member and the substantially planar wedge surfaces 24 and 38.

Figure 2A:
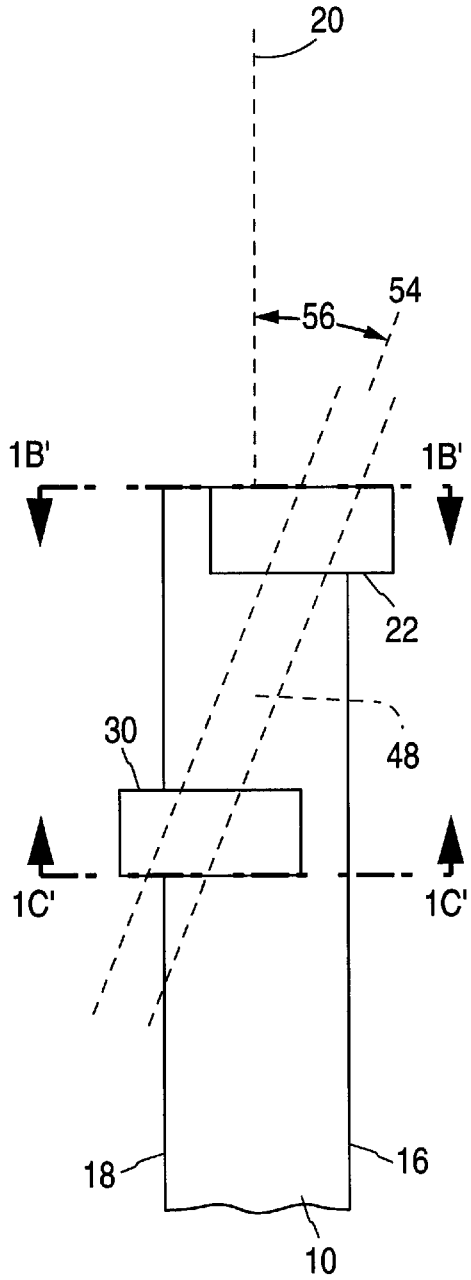
FIG. 2A is a top view of the extension member of FIG. 1A engaging a tool handle with a substantial offset angle between the axis of the extension member and the axis of the tool handle.
Figure 2B:
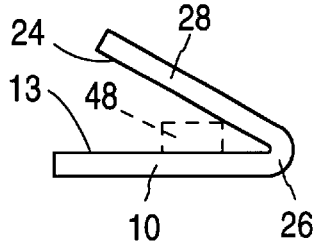
FIG. 2B is a partial cross-sectional view of a tool wedged into a first wedge coupler along the line 1B—1B of FIG. 2A.
Figure 2C:
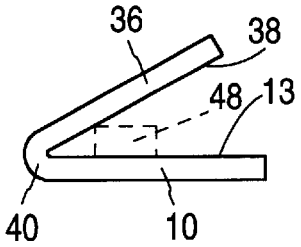
FIG. 2C is a partial cross-sectional view of a tool wedged into a second wedge coupler along the line 1C—1C of FIG. 2A.

The extension device shown in FIG. 1 is particularly useful for extending the effective handle length of wrenches having a handle of variable cross-sectional size. The width 58 and thickness 60 of common tool handles is variable. For example, mechanics often have a dozen or more wrenches of slightly varying width and thickness. The extension device of FIG. 1 accommodates a variety of handle sizes. A slight rotation 56 of handle 48 results in the handle 48 being counterpoised braced between first wedge region 50 and second wedge region 52. In practice, a rotation angle 56 of a few degrees (e.g., 1-to-5 degrees) accommodates a large variation in handle width 58 and thickness 60 of the tool handle 48 with the tool handle 48 remaining substantially co-axial with the extension member 10. However, as indicated in FIG. 2A, in the extension device of the present invention wedge locking may still be achieved for tools having a comparatively small cross-sectional area with a rotation angle 56 in the range of 5-to-15 degrees. As indicated in FIG. 2B and 2C, the wedge surface regions 24 and 38 permit wedge-locking to be achieved even for a substantial rotation angle 56. The present invention also allows the effective length of the wrench to be varied by altering the position of the tool handle 48 in the brace 42 (e.g., bracing the handle at different segments of the handle). This permits a mechanic to readily adjust the effective length of the tool.

The extension device shown in FIG. 1 is particularly useful for extending wrenches used in high-torque applications. The counterpoised wedge brace results in a mechanically strong engagement of the tool handle 48 when the tool handle 48 is used to apply a large torque. At high torque levels the tool handle 48 becomes strongly wedged between wedge regions 50 and 52. The opposed wedge surfaces result in a counterpoised wedge effect which firmly grips and holds the wrench in place during high torque applications. This facilitates using the extension member 10 for high torque applications with a variety of tools with different handle dimensions.

Since the wedge effect occurs in a comparatively small wedge effect region, substantial modifications to the structure of the extension member may be made to accommodate a variety of handle configurations. As shown in FIG. 1, the extension member 10 may be a substantially planar strip such that the wedge effect occurs in a wedge slot comprised of the wedge surface and regions of the extension member disposed adjacent to the wedge surface. The wedge effect occurs primarily in a comparatively small region between the wedge surface and a portion of the extension member disposed adjacent to the wedge surface along the wedge slot. As shown in FIG. 3A, 3B, and 3C additional riser segments 200 may be disposed on the surface 13 of the extension member 10 along the wedge slots. Riser segments 200 with riser surfaces 210 elevate the wedge slots 44 and 46 above the surface 13 of the extension member 10. Raising the wedge slots 44 and 46 above the surface of the extension member 10 permits a more arbitrary shaped extension member (e.g., oblong) to support wedge slots. Also, for the case of tools with curved handles, elevated wedge slots permit the handle to be engaged by the wedge slots along two wedge effect regions without interference from the extension member.

Figure 5:
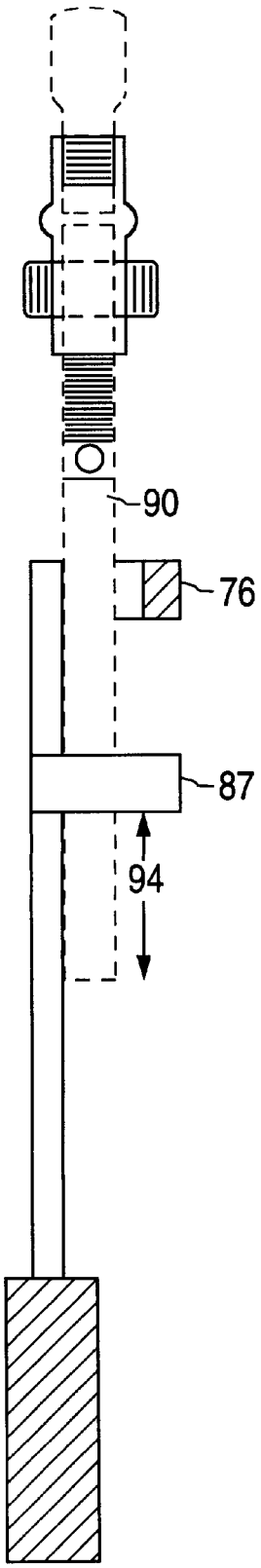
FIG. 5 is a top view of the extension device of FIG. 4 engaging a pipe wrench being used to tighten a pipe.
Figure 6:
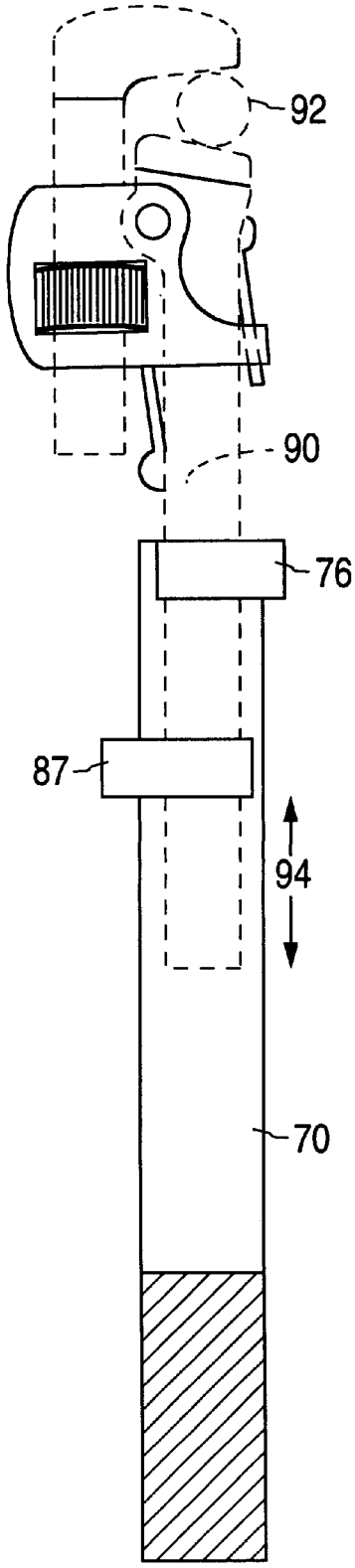
FIG. 6 is a side view of the extension device of FIG. 4 engaging a pipe wrench.

As shown in FIGS. 4, 5, and 6, in one embodiment the extension device of the present invention may be used to extend the effective length of pipe wrenches. FIG. 4 is perspective view of an extension handle for extending pipe wrenches. An extension member 70 has a first end 66, a second end 68, a first side 74 and a second a side 75. The second end 68 may also comprise cushioning to facilitate a strong hand grip by the user. A first wedge finger 76 comprises a first wedge finger segment 78 and a second wedge finger segment 80. First wedge finger segment 78 has a wedge surface 79. A second wedge finger 87 comprises a first opposed wedge finger segment 84 and a second opposed wedge finger segment 86. First opposed wedge finger segment 84 has a wedge surface 85 disposed on it. As shown in FIG. 4, wedge finger segments 86 and 80 are substantially normal to the surface 71 of the extension member 70 such that they displace the wedge surfaces 79 and 85 from the plane of the extension member 70. This is desirable in order that the extension member 70 may be used to extend comparatively thick tool handles, such as that of a pipe wrench. FIG. 5 is a top view of a the extension member 70 of FIG. 4 with a pipe wrench 90 wedge braced while the pipe wrench 90 is used to tighten a pipe 92 (shown in phantom). As shown in FIGS. 5 and 6, the pipe wrench may be translated relative to the wedge fingers 76 and 87 by a distance 94 such that different segments of the handle of pipe wrench 90 are engaged. The effective length of the wrench may thus be readily adjusted over a considerable range. This permits a mechanic to adjustable extend a pipe wrench, which is particularly useful in a situation where, for example, the maximum lever arm length is constrained by other pipes or walls.

Figure 9:
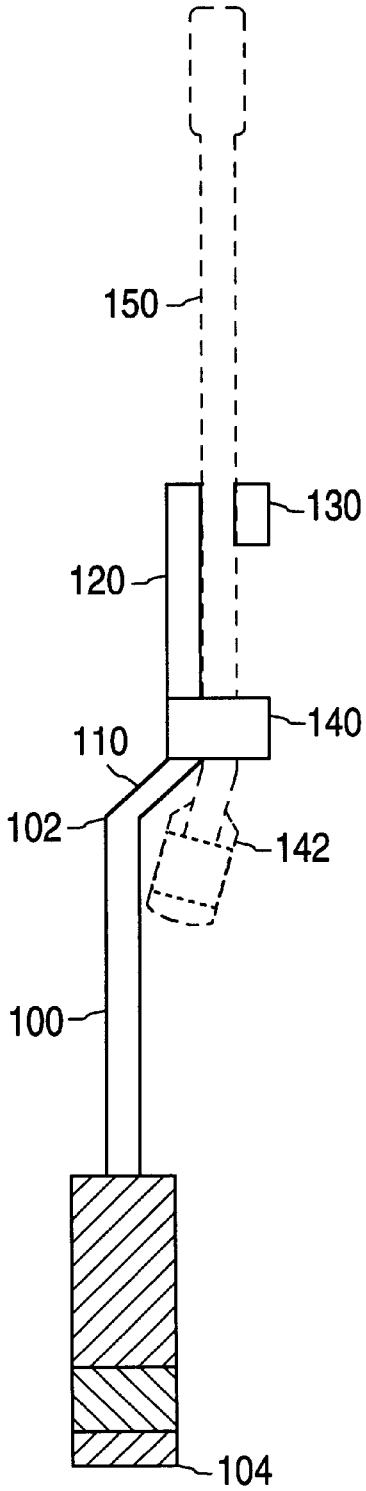
FIG. 9 is a side view of the extension device of FIG. 7 engaging a box-end wrench.
Figure 10:
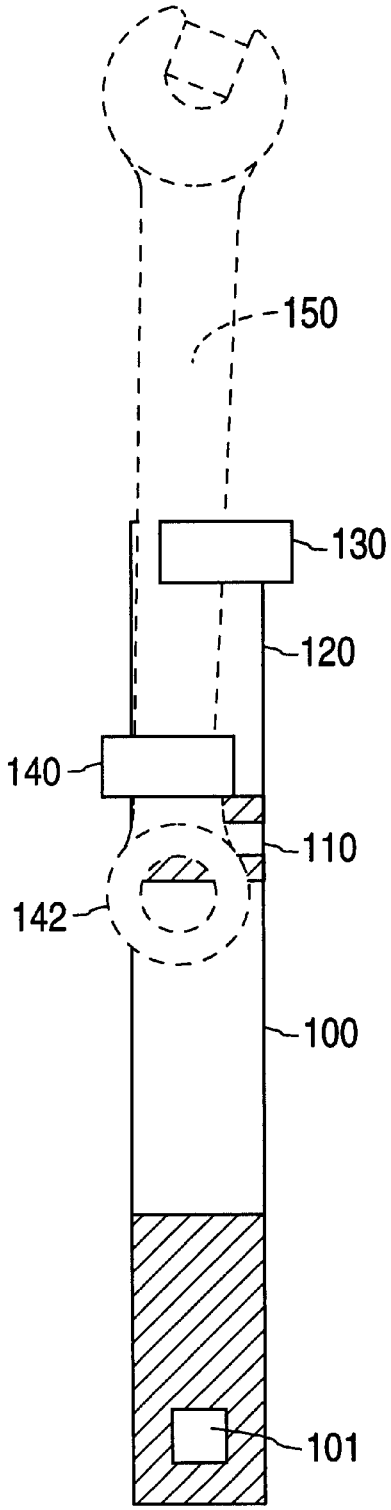
FIG. 10 is a top view of the extension device of FIG. 7 engaging a box-end wrench used to tighten a nut.

In a second embodiment of the present invention, the extension device is further modified to incorporate an offset handle portion to facilitate the use of the extension device with box-end wrenches. As shown in FIGS. 7, 8, 9, and 10, the extension device may also be modified to accommodate a variety of open-ended and box-end wrench designs. Mechanics commonly have a variety of sizes and styles of open-ended and box-end wrenches in their tool collection. It is desirable to have one extension device that can extend a large variety of common open-end and box-end wrenches. As shown in the side view of FIGS. 7 and 8, the extension device has a handle portion 100. The handle may also have means, such as a dimensioned socket 101, to receive a ratchet or socket head to permit the handle to be turned by a ratchet or socket. Preferably, the handle portion 100 is cushioned to facilitate a hand grip. The handle portion has a first end 102, a second end 104, a first longitudinal side 106 and a second longitudinal side 108. The first end of handle 100 is coupled to an offset mating member 110. The offset mating member 110 is angled with respect to the plane of the handle. An extension member 120 is coupled to offset mating member 110 along the second end 122 of extension member 120. A first wedge finger 130 is disposed proximate to the first end 124 of extension member 120. A second opposing wedge finger 140 is disposed proximate to the second end 122 of extension member 120. As shown in FIG. 9 and FIG. 10, a box-end wrench 150 may be wedge-braced by the wedge fingers 130 and 140 with the angled box-end 142 accommodated by the displacement of the offset mating member 110.

The offset mating member 110 is preferably dimensioned such that common angled box-ends are accommodated with the body of wrench 150 residing in one plane. For example, if no offset mating member 110 was provided, the wrench 150 could only be inserted with the angled box end 142 extending above the plane of the wedge brace, making it difficult in many applications to turn the wrench in the same plane as the bolt or nut being tightened (e.g., the extended wrench may have to be cocked relative to the plane of the nut, which is undesirable). The offset mating member 110 facilitates a substantially co-planar wedge-bracing of the wrench and the extension device. As shown in FIG. 9, the engaged wrench is substantially in the same plane as the extension handle.

The wrench extender of the present invention may be manufactured by a variety of well-known manufacturing techniques. For example, the wrench may be manufactured using standard forging and/or flat plate stamping and bending. The wedge fingers should be manufactured using a sufficient thickness of steel to provide the required tensile strength. This will partially depend upon the particular application and the size of the wrenches to be extended. For example, many common wrenches are used to apply up to 250 to 300 foot pounds of torque. However, in some applications, particularly those using larger wrenches, wrenches are used to apply 300 to 500 foot pounds of torque. Consequently, the precise dimensions of the wedge fingers will depend partially on the requisite tensile strength for a particular application. Those skilled in the art of mechanical engineering are presumed familiar with techniques to calculate the required finger dimensions for a particular application.

The wedge surfaces are angled with respect to the plane of the extension member. There is a tradeoff between the angle of the wedge surfaces, the efficacy of the wedge effect, and the ability to accommodate a large variety of handle dimensions. A larger angle permits a wider variety of handle widths and thicknesses to be engaged by the wedge surfaces. However, the inventor's experimental studies lead him to believe that too large a wedge surface angle may degrade the wedge effect. A shallow angle provides good wedge coupling. However, a shallow angle will also restrict the width of the tool handle to a width substantially less than the width of the extension member. The inventor believes that the wedge surface is preferably angled about thirty degrees for box-end wrenches commonly used by mechanics, although an angle up to forty-five degrees may be acceptable for some applications.

Preferably, the wedge effect is achieved with only a few degrees of misalignment between the axis of the tool handle and the axis of the extension member. However, the extension device of the present invention may be used in those cases, such as tool handles substantially narrower than the extension member, in which a wedge lock is achieved with an appreciable misalignment. The extension device of the present invention will function satisfactorily for cases where wedge locking is achieved at a misalignment angle of ten-to-fifteen degrees. However, many common wrench sizes (e.g., ¼" and ⅜" wrenches) typically have ergonomic handles which are comparable in cross-sectional size (e.g., thickness and widths within about 30%). Consequently, a wide variety of sizes and styles of wrenches may be wedge locked in one extension device with the axis of the tool remaining substantially conformal to the axis of the extension member.

The universal nature by which the counterpoised wedge couplers engage a wide variety of handle shapes and sizes makes the present invention an extremely versatile extension device with a wide variety of potential applications. The wedge-effect couplers of the present invention will wedge-lock a wide variety of handle shapes. For example, the inventor has successfully used the extension device of the present invention to increase the effective length of a variety of handles with a substantially round cross-section. The extension device of the present invention is thus useful to increase the lever arm length for lug wrenches and ratchet wrenches with cylindrical handles. Also, there are other applications, such as extending the length of the handle of a car-jack or increasing the effective length of a crowbar, where the extension device of the present invention may be beneficially used to increase the lever arm length of a handle.

The inventor believes that it is desirable that the body of a wrench handle lies supported on the top surface of the extension member when it is wedged into place. This facilitates a strong mechanical coupling, particularly if the wrench is slightly cocked with respect to a nut or bolt that is to be loosened. However, it is not essential for all applications. In particular, the wedge slots of the wedge couplers may be slightly elevated with respect to the plane of the extension member such that the body of the wrench does not lie on the top surface of the extension member. This would permit wrenches with curved handles to be accommodated in the wedge brace. The inventor also believes that it is desirable, for a low cost extension device, to utilize solid wedge fingers attached to the sides of the extension member. However, there may be applications where it is desirable for the wedge fingers to be disposed in the central region of the extension member rather than being directly attached to the sides of the extension member. For example, it may be desirable in some high-torque applications to alter the positions of the fingers to increase the mechanical strength of the fingers by coupling the fingers to the extension member with a reinforcing buttress. Also, while rigid wedge fingers are the simplest to manufacture, wedge fingers that permit a mechanical adjustment of the angle or elevation of the wedge surface may be desirable for some applications.

The hand grip portion of the extension device preferably is cushioned and shaped to permit a strong grip. A variety of grip designs could be used. However, a cushioned grip which is generally oblong in shape and dimensioned to be readily grasped by one hand is preferred for many applications.

The extension device may be fabricated in a variety of sizes. Common geometry can be used to calculate the range of handle sizes which may be successfully wedged for a particular wedge finger arrangement. Generally, the separation 32 between wedge couplers should be larger than the maximum width of the tool which is to be extended. This permits the tool to be inserted generally parallel to the direction of the wedge fingers (normal to the axis of the extension member) and then rotated into place. Increasing the separation 32 tends to reduce the offset angle 56. However, increasing the separation 32 has the drawback that it reduces the ability of a mechanic to adjust the effective length of the wrench by wedging different segments of the handle. As an illustrative example, a mechanic may have a set of wrenches with handles about 8" long in between the box-end and open end of the wrench. If the wedge brace, including the wedge fingers, is 5" long, then the wrench may be adjusted by 3".

Figure 7:
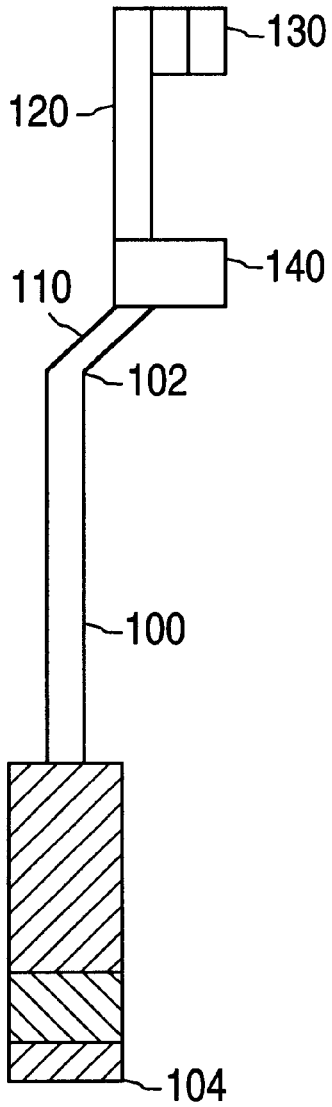
FIG. 7 is a side view of an extension device of the present invention for extending box-end wrenches.
Figure 8:
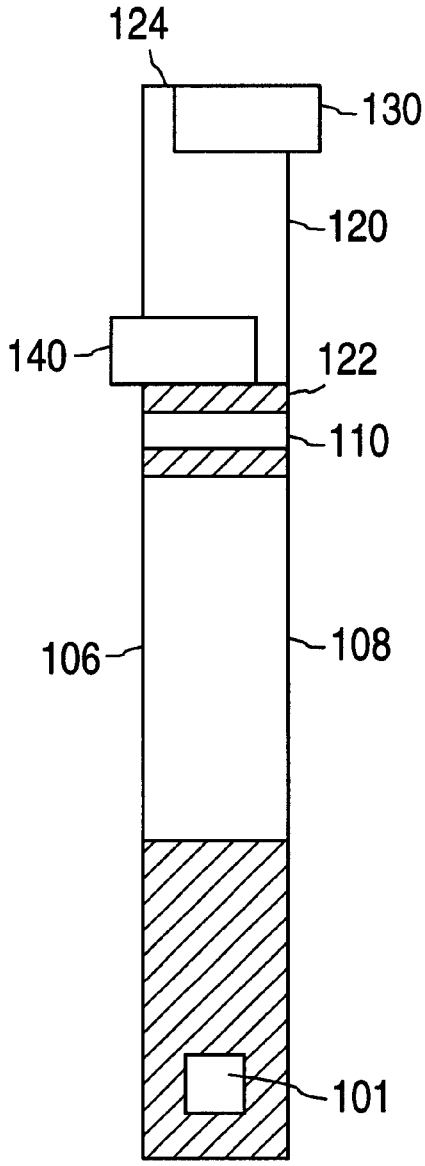
FIG. 8 is a top view of the extension device of FIG. 7.

One prototype constructed by the inventor comprises an extension device similar to that shown in FIG. 7. The handle portion 100 comprises a steel strip about 1" wide and 9.5" long. An additional rubber or plastic grip on the end portion facilitates a strong hand grip on the handle portion. The offset mating member 110 is angled at about thirty degrees and rises up by an elevation of about ⅝". The extension member 120 has a total length of about 3.5" The separation between wedge fingers 130 and 140 is about 1.5". The steel is about ⅝" thick throughout the entire extension device. The wedge fingers have wedge surfaces which are angled at about thirty degrees with respect to the plane of the extension member 120. A bending process is used to form the wedge fingers. Consequently, while the wedge fingers 130 and 140 define generally V-shaped slots, there is a radius of curvature formed by the bending process such that the vertex of the V-shaped slots extends about 3/16" beyond the edge of the strip. This one extension device may be used to extend most common automotive wrenches. Common wrench sizes may be quickly inserted.

The thickness of the steel is preferably thick enough (e.g., ⅝" in the inventor's prototype) such that comparatively little flexure of the wedge fingers occurs even at high torque levels. It is desirable that a wrench be firmly wedge locked into place when torque is applied. However if the steel is too thin the wedge fingers might flex such that the wrench became stuck in the wedge fingers after high-torque use. While a wedge effect is desirable to lock the wrench into place during use, it is desirable that the wrench may be quickly removed from the wedge brace when the wrench is not in use.

Although a preferred embodiment of the present invention and modifications thereof have been described in detail herein, it is to be understood that this invention is not limited to those precise embodiments and modifications, and that other modifications and variations may be affected by one of ordinary skill in the art without departing from the spirit and scope of the invention as defined in the appended claims.

What is claimed is:

1. An extension device for increasing the effective length of a handle having a longitudinal handle axis comprising:

an extension member having a longitudinal axis, a handle portion and a substantially planar surface;

a first finger coupled to said extension member;

a second finger coupled to said extension member, said second finger opposed to said first finger and spaced apart from said first finger along said longitudinal axis of said extension member;

a first surface disposed on said first finger forming a first slot between said first finger and a first portion of the substantially planar surface of said extension member; and a second surface disposed on said second finger forming a second slot between said second finger and a second portion of the substantially planar surface of said extension member;

said first and second fingers being directed so that said first and second slots open in opposed directions so that a handle inserted into said slots along the axis of said extension member may be engaged by both the first slot and the second slot upon the application of a force transverse to the longitudinal axis of said extension member;

whereby said slots are shaped so that when a torque is applied to the extension device a first region of the handle is wedged in said first slot and a second region of the handle is wedged in said second slot, whereby the counterpoised forces lock the handle to the extension device.

2. The extension device of claim 1, wherein the slots are substantially V-shaped in said first and second regions with an arc angle less than about forty-five degrees.

3. The extension device of claim 2, wherein the fingers are displaced relative to the substantially planar surface of the extension member by displacement finger segments.

4. The extension device of claim 2, wherein said arc angle is about 30 degrees.

5. An extension device for receiving a wrench, comprising:

a handle having first and second ends;

an offset mating member having first and second ends and first and second longitudinal sides, the first end of the offset mating member coupled to the first end of the handle;

an extension member, the extension member having first and second ends and first and second longitudinal sides, the second end of the extension member coupled to the second end of the offset mating member such that the longitudinal axis of the extension member is offset from the longitudinal axis of the handle in a direction toward the longitudinal axis of a wrench wedge locked in said extension device;

a first wedge coupler forming a first wedge slot with the extension member and disposed proximate to the first end of the extension member; and a second wedge coupler forming a second slot with the extension member, said second slot disposed proximate to the second end of the extension member, the second slot generally opposed to the first slot;

whereby the first wedge coupler and the second wedge coupler are shaped such that the wrench may be counterpoised wedge-locked between the counterpoised wedge couplers with the longitudinal axis of the wrench handle substantially aligned to the longitudinal axis of the extension member;

whereby said slots are shaped so that when a torque is applied to the extension device a first region of the wrench handle is wedged in said first slot and a second region of the wrench handle is wedged in said second slot, whereby the counterpoised forces lock the wrench handle to the extension device and;

whereby a surface of the wrench handle lies along a plane coplanar with the extension member when the wrench is locked to the extension device.

6. The extension device of claim 5, wherein the offset mating member is angled at least thirty degrees with respect to the plane of the extension member.

7. The extension device of any previous claim, wherein the size of the slots relative to the handle is selected so that the longitudinal axis of the wedged handle is substantially aligned with the longitudinal axis of the extension member.

8. The extension device of claim 5, wherein the wedge couplers form generally V-shaped slots having an arc angle of less that forty-five degrees.

9. The extension device of claim 8, wherein each of the generally v-shaped slots has an arc angle of about thirty degrees.

10. The extension device of claim 5, wherein the extension device is for use with a wrench in which one end of the wrench is angled with respect to the handle of the wrench, wherein said offset mating member is angled by a predetermined angle with respect to the plane of the handle and is a predetermined length such that when said wrench end angles toward the handle when the wrench is installed in the extension device, said offset mating member provides clearance for said angled end of the wrench.

11. An extension device for increasing the effective length of a handle comprising:

an extension member having a longitudinal axis, a substantially planar surface, and a first end and a second end, said extension member coupled to a handle portion;

a first wedge coupler proximate to the first end of the extension member, said first wedge coupler comprising a first wedge surface forming a first generally V-shaped slot with a first portion of the substantially planar surface of the extension member; and a second wedge coupler separated from the first wedge coupler along the axis of said extension member, said second wedge coupler comprising a second wedge surface forming a second generally V-shaped slot with a second portion of the substantially planar surface of the extension member;

wherein the first wedge coupler and the second wedge coupler have opposed wedge surfaces dimensioned such that the handle may be engaged by the wedge couplers with the longitudinal axis of the handle substantially aligned to the longitudinal axis of the extension member;

whereby said slots are shaped so that when a torque is applied to the extension device a first region of the handle is wedged in said first slot and a second region of the handle is wedged in said second slot, whereby the counterpoised forces lock the handle to the extension device.

12. The extension device of claim 11, wherein each V-shaped slot has an arc angle of less than 45 degrees.

13. The extension device of claim 11, wherein said extension member has two opposed longitudinal sides and the wedge surface of each said wedge coupler is connected to one of the longitudinal sides of the extension member by a transition surface which elevates the wedge surface of the extension member by a distance substantially greater that the thickness of the extension member.

14. The extension device of claim 10, wherein the wrench handle has a minimum length and the extension member has a length less than the minimum length of the handle of the wrench.

15. The extension device of claim 12 wherein each V-shaped slot has an arc-angle of about 30 degrees.

* * * * *